US005577936A

United States Patent [19]

Hahn

[11] Patent Number: 5,577,936

[45] Date of Patent: Nov. 26, 1996

[54] WAFER RETENTION IN AN ELECTRICAL RECEPTACLE

[75] Inventor: Marlyn E. Hahn, York, Pa.

[73] Assignee: Berg Technology, Inc., Reno, Nev.

[21] Appl. No.: 535,354

[22] Filed: Sep. 28, 1995

[51] Int. Cl.[6] ..... H01R 13/648

[52] U.S. Cl. ..... 439/607; 439/634; 439/701

[58] Field of Search ..... 439/607, 608, 439/92, 95, 629–637, 701

[56] References Cited

U.S. PATENT DOCUMENTS

| | | | |
|---|---|---|---|
| 4,824,383 | 4/1989 | Lemke | 439/108 |
| 4,925,400 | 5/1990 | Blair et al. | 439/609 X |
| 5,057,028 | 10/1991 | Lemke et al. | 439/101 |
| 5,169,324 | 12/1992 | Lemke et al. | 439/101 |
| 5,478,259 | 12/1995 | Noschese | 439/607 |

*Primary Examiner*—Khiem Nguyen

*Attorney, Agent, or Firm*—Bruce J. Bowman; M. Richard Page; Daniel J. Long

[57] ABSTRACT

An electrical terminal carrying substrate or wafer is maintained in a channel of a die-cast metal frame of an electrical receptacle by peens that create radiused retaining lips. The slip-fit wafer is thus held into place within the channel at one end of the receptacle housing by a plurality of lips that extend over flange portions integral with the wafer. The flange rests on ledges integral with the frame within the channel. The lips and flanges eliminate interference fit wafers that tend to bow the receptacle frame increasing chances of open circuits or poor contact between the receptacle terminals and the mating plug terminals.

11 Claims, 2 Drawing Sheets

WAFER RETENTION IN AN ELECTRICAL RECEPTACLE

FIELD OF THE INVENTION

The present invention relates to electrical connectors and more particularly, to the retention of terminal carriers or wafers within receptacle housings.

BACKGROUND OF THE INVENTION

Connectors, namely plugs and receptacles for connecting wires from various devices or sources to other devices have evolved over the years as those devices or sources have changed. Different applications have also required new and varied types of plugs and connectors. Most notably, with the advent of computers and related peripherals, electrical plugs or connectors have been developed to releasably link the cables or wires necessary to carry and communicate information from one device or source to another device.

In the modern design of electrical connectors, which include plugs and receptacles, the terminals or leads are embedded in or on substratums. The substratums are then received in a frame or housing to constitute the connector. Because the connectors are of a multi-piece construction, it is important that the substratums remain secure within the frame.

In order to retain the substratum and terminals within the receptacle frame, the prior art made the substratum slightly oversized relative to the housing opening in order to create an interference fit therebetween. The interference fit essentially wedged the wafer into the connector frame to thereby hold the terminals in place.

However, the problem with the prior art interference fit is that it has a tendency to bow the frame. Bowing of the frame can cause the terminal to bow creating an open circuit between the plug and receptacle contacts, as well as poor connections therebetween, that may hinder device performance.

It is thus an object of the present invention to provide a terminal carrying wafer for a receptacle that does not cause bowing of the receptacle frame, and is still securely maintained within the frame.

It is another object of the present invention to reduce wafer movement within a receptacle metal shell or frame.

SUMMARY OF THE INVENTION

In keeping with the above objects, the present invention is an electrical receptacle that maintains a terminal carrying wafer or substratum within a metal frame through mechanical peening of the frame. The peening creates a lip on the frame that engages a flange on the wafer.

In a preferred form, a plurality of peens are formed at the solder-tail end of the frame. The peens create stops that engage flanges on the wafer to maintain the flange end of the wafer in place within a longitudinal channel formed in the frame. The peens are spaced along one side of the channel corresponding in placement to flange cutouts in the frame. The flange cutouts allow receipt of the wafer flanges. On the end opposite the solder-tail end of the frame, the wafer is mechanically riveted to the frame in order to secure the wafer and terminals at the plug receiving end of the frame.

Generally, the receptacle has two parallel, spaced-apart longitudinal channels in which each channel receives a wafer with terminals. Each wafer has three flanges, one at each longitudinal end, and a middle flange, with the middle flange being longer than the two end flanges. One peen is formed at each longitudinal end of each channel at the flange cutout area, while two peens are formed at the middle flange cutout area. Again, the end of the wafers opposite the flanges are attached to the end of the walls of the channels.

BRIEF DESCRIPTION OF THE DRAWINGS

So that the manner in which any above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
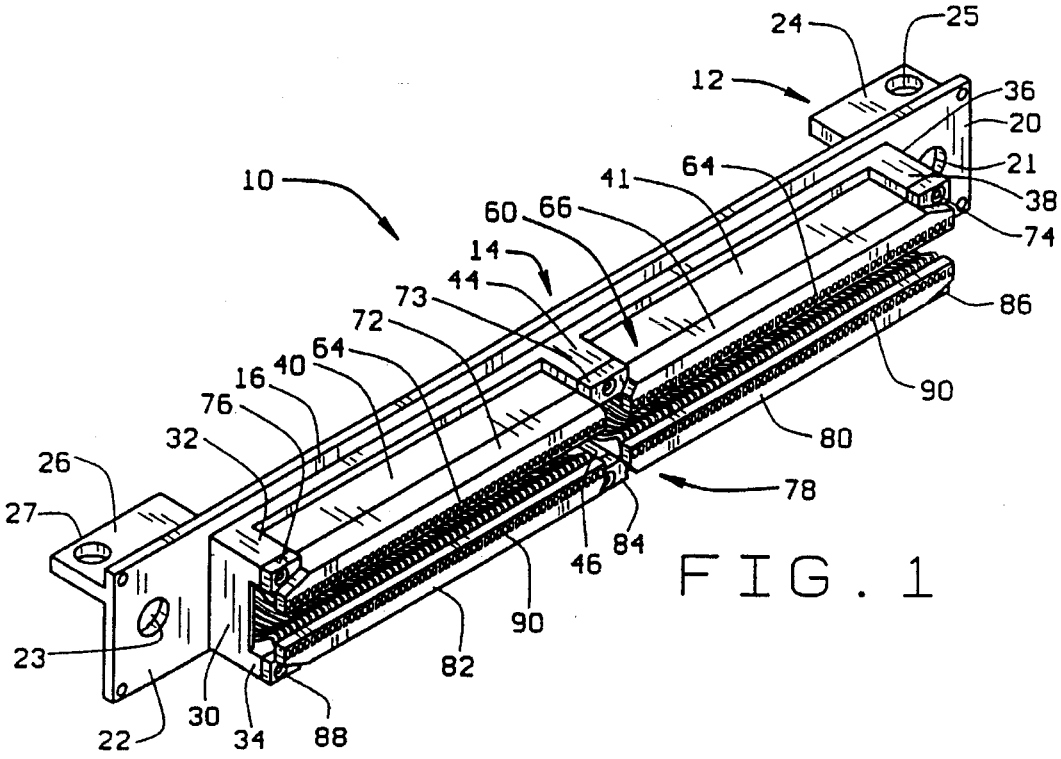
FIG. 1 is a perspective view of a straddle-mount type electrical receptacle embodying the present invention.

Referring now to FIG. 1 there is shown an electrical connector, and specifically what is termed an electrical receptacle, generally designated 10 that is adapted to receive and be releasably connected to an electrical connector plug (not shown). The receptacle 10 is defined in part by a housing, casing, or frame structure generally designated 12, that is preferably made of a die-cast metal such as zinc. The housing 12 comprises a frame 14 defined by a top longitudinal rail 16 and a lower longitudinal rail 18 coupled to and extending between a right side or end plate 20 and a left side or end plate 22. Transversely extending from the rear of each side plate 20, 22 is a rectangular flange 24, 26, respectively. Each flange 24 and 26 includes a bore 25 and 27 respectively for mounting the connector 10 to the board or device via a screw or bolt (not shown). It should be understood that while the connector 10 is pictured and described as a straddle-mount type connector, other types or styles of connectors may utilize the teachings of the present invention. Additionally, the right and left sides 20, 22 include a respective bore 21, 23 for mounting the connector 10 to a bulkhead or device via a screw or bolt (not shown).

Disposed on the left side plate 22 at the junction of the upper and lower longitudinal rails 16 and 18 is a left U-shaped wall 30 having an upper post 32 and a lower post 34 oppositely disposed on the ends of the wall 30. Disposed on the right side plate 20 at the junction of the upper and lower longitudinal rails 16 and 18 is a right U-shaped wall 36 having an upper post 38 and a lower post (not seen) oppositely disposed on the ends of the wall 36. Extending from the upper longitudinal rail 16 between the U-shaped walls 30 and 36 is an upper wall defined by an upper left side wall section 40, and an upper right side wall section 41 with a central post portion 44 therebetween. Although not seen in the Figures, the connector 10 includes a lower wall defined by a lower left side wall section and a lower right side wall section having a central post portion 46 disposed therebetween in identical manner to the upper wall.

Figure 2:
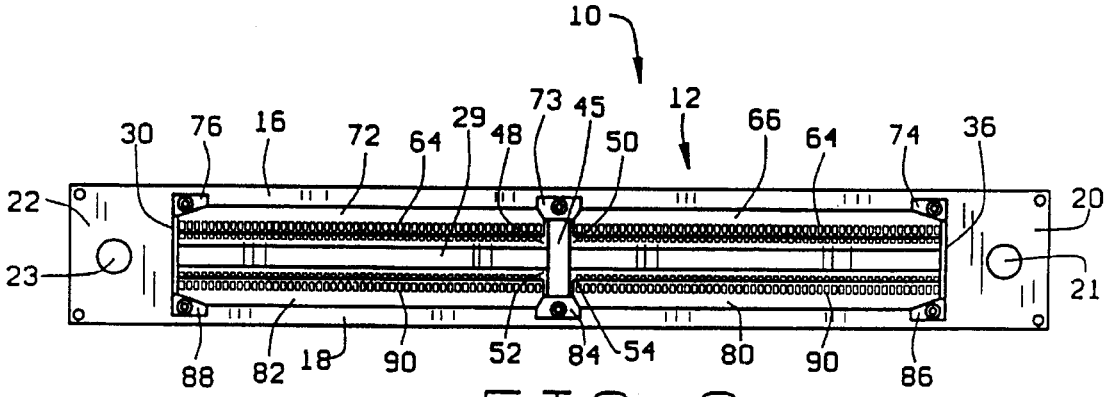
FIG. 2 is a top view of the electrical receptacle of FIG. 1.

With additional reference to FIG. 2, the frame 12 further includes a central longitudinal rail 29 extending between the left and right side walls 30, 36, and the upper and lower longitudinal rails 16, 18. A central transverse member 45 extends between the upper and lower central posts 44, 46. The frame 12 has four (4) longitudinal rectangular openings 48, 50, 52, 54 that are thus defined by the central longitudinal rail 29, the central transverse member 45, the upper left and right walls 40, 41, and the lower walls (not shown). The rectangular openings 48, 50, 52, 54 extend completely through the frame 12.

Figure 4:
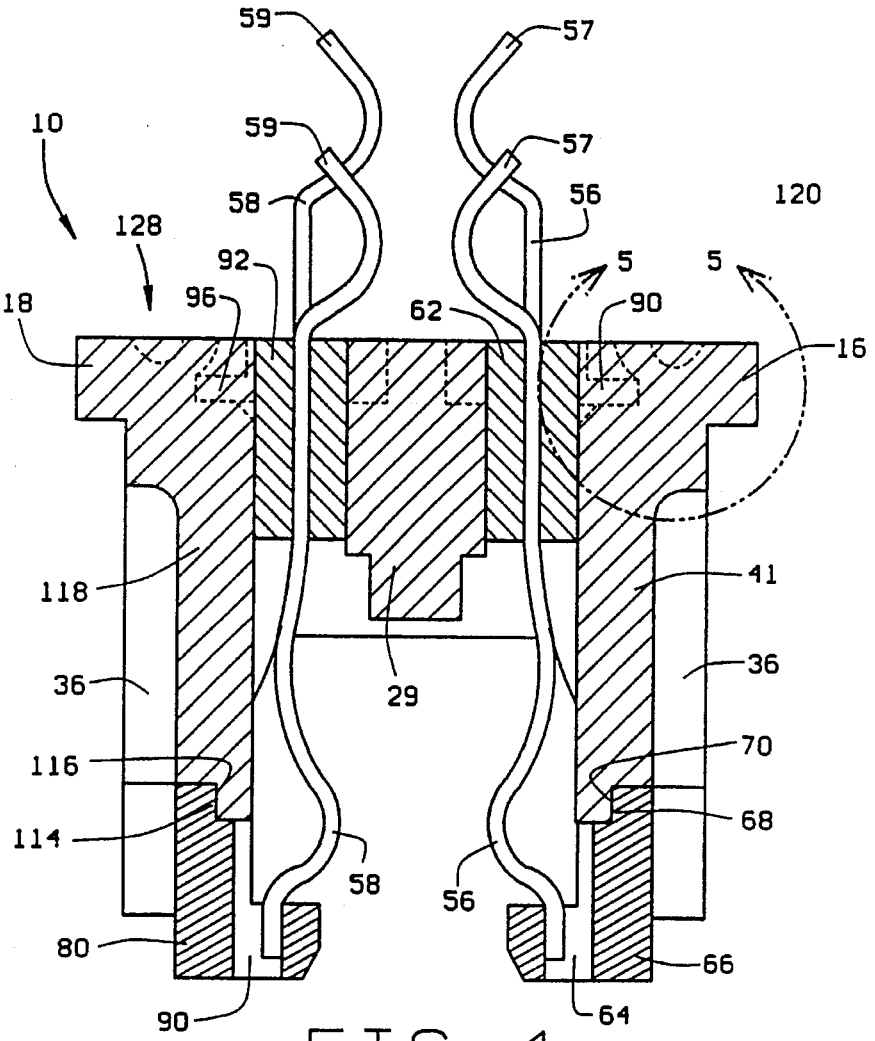
FIG. 4 is an enlarged cross-section view of the electrical receptacle taken along line 4—4 of FIG. 3.

The receptacle 10 is further defined in part by terminal contacts and their carrier(s) or wafer(s) which are assembled to the die-cast frame 12 after formation of the frame 12. The receptacle 10 includes a plurality of terminals or contacts arranged in two (2) essentially parallel rows along the longitudinal length of the frame 12 within the rectangular openings 48, 50, 52, 54. With additional reference to FIG. 4, two terminals from each row are shown, with terminals 56 corresponding to the first or upper row, and terminals 58 corresponding to the second or lower row. The terminals 56 in the first row have length-staggered solder-tails 57 such that adjacent solder-tails 57 are at different heights in order to facilitate connection. The terminals 58 in the second row also have length-staggered solder-tails 59 in like manner to the terminals 56 in order to facilitate connection. The terminals 56, 58 are sinuous-shaped to facilitate contact with the mating plug and provide a cantilevered spring action within the receptacle as is known in the art.

The terminals 56 are, at one end, embedded into a longitudinal substrate or substratum 62 such that the solder-tails 57 extend therefrom. The substratum 62 is a dielectric, and preferably a plastic, that extends the entire longitudinal length of the frame 14. It should be understood that the central transverse member 45 divides only the front or plug receiving portion of the receptacle into four (4) openings 48, 50, 52, 54. The rear or solder-tail end of the receptacle is divided into two (2) longitudinal channels. The other end of the terminals 56 is maintained in rectangular holes 64 in a connected two-piece end cap 60 that is separate from the substratum 62 such that the terminals 56 extend between the substratum 62 and the two-piece end cap 60. The end cap 60 has a longitudinal notch 68 that fits into a corresponding complementary longitudinal notch 70 in the walls 40, 41 in order to help maintain the end cap 60 in place. As best seen in FIG. 1, the longitudinal end cap 60 is formed as one piece but has a right end side 66 and a left end side 72. Integral with and between the right and left ends 66, 72 is a post cap 73 that is received over the upper central post 44. At the right side of the end 66 is a right post cap 74 that is attached to the upper right post 38. At the left side of the end 72 is a left post cap 76 that is attached to the upper left post 32. In order to secure the end cap in place, rivets extend through the post caps 73, 74, 76 and into the respective posts 32, 38, 44.

The terminals 58 are, at one end, embedded into a longitudinal substrate or substratum 92 such that the solder-tails 59 extend therefrom. The substratum 92 is a dielectric, and preferably a plastic that extends the entire longitudinal length of the respective channel. In like manner to the upper end cap 60, the bottom end cap 78 consists of a right end 80 and a left end 82. The right and left ends 80, 82 are separated by a middle post cap 84 that is affixed to the lower middle post 46. On the end of the right end 80 is a right post cap 86 that is attached to the post (not shown), while on the end of the left end 82 is a left post cap 88 that is affixed to the lower left post 34. Thus, the lower or bottom wafer 78, in like manner to the upper wafer 60, is in two (2) integral portions, with a plurality of rectangular holes 90 in which is received an end of the terminals 58, while the solder-tail end 59 of the terminals 58 are imbedded in the longitudinal substrate or substratum 92. Also, the end cap 78 has a longitudinal notch 114 that fits into a corresponding complementary longitudinal notch 116 in the lower wall 118. The end cap 78 is likewise riveted through the post caps 84, 86, 88 to the respective posts 46, 34, with the third post not shown.

Figure 3:
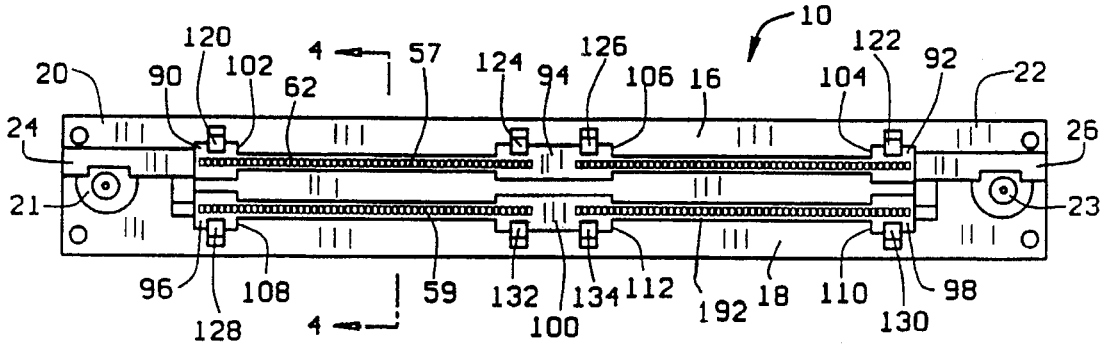
FIG. 3 is a bottom view of the electrical receptacle.

Referring in particular to FIG. 3, it is evident that the connector 10 includes two (2) longitudinal substratums 62, 92 that are one part of each of the upper and lower terminal carriers. The substratum 62 has a left flange portion 90, a right flange portion 192, and a middle flange portion 94. The respective flanges 90, 192, and 94 are received in respective flange cutout sections 102, 104, and 106 in the rear of the frame adjacent the channel. In like manner, the substratum 92 has a left flange portion 96, a right flange portion 98 and a middle flange portion 100. The respective flanges 96, 98, and 100 are received in respective flange cutout sections 108, 110, and 112 in the rear of the frame adjacent the channel.

Formed at each cutout portion 102 and 104 is a single respective peen 120, 122. Formed at the center cutout portion 106 are two peens 124, 126. Formed at each frame cutout portion 108, 110 is a single respective peen 128, 130, while formed at the center cutout portion 112 are two peens 132, 134. The peens are formed in order to retain the substratums in their proper position within the respective channel.

Figure 5:
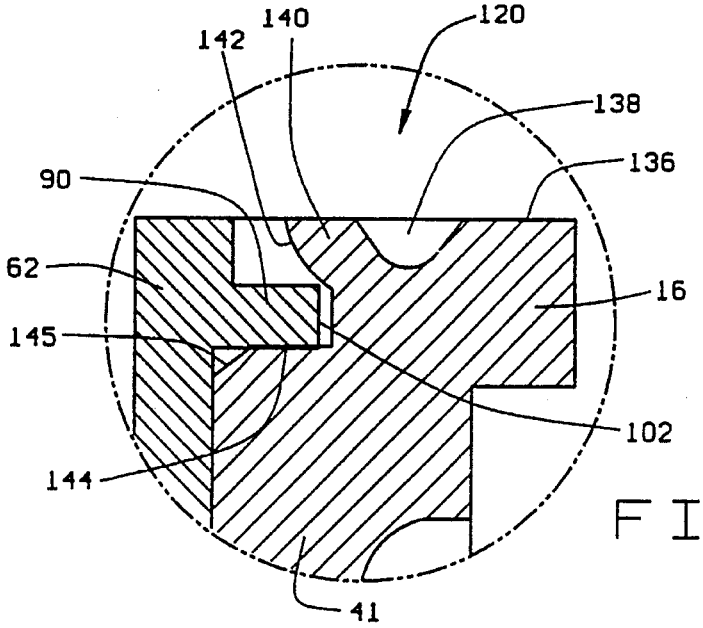
FIG. 5 is an enlarged partial view of a wafer retaining portion according to the present invention taken along circle 5—5 of FIG. 4.

With reference now to FIG. 5, one peen 120 in particular will be described as it is representative of the other peens. The peen 120 in the surface 136 forms a concave indention 138 and creates a convex lip 140 with a radiused edge 142. The lip 140 extends inwardly towards the substratum 62. Additionally, the cutout portion 102 defines a ledge 144 with an angled front face 145. The flange 90 is retained on the ledge 144. The lip 140 extends approximately ⅓ of the way over the ledge 144 to prevent the flange 90, and thus the substratum 62, from falling out of the channel. The substratum 62 is also prevented from falling out from the front of the frame by the terminals being engaged to the end cap.

Each peen in like manner to that described, forms indentions and radiused lips to positively stop or retain the longitudinal wafer in place within the frame 12. This is necessary since without the retention, the longitudinal wafer with its terminals would fall through the rear of the frame 12.

While the foregoing is directed to the preferred embodiment of the present invention, other and further embodiments of the invention may be devised without departing from the basic scope thereof.

What is claimed is:

1. An electrical receptacle comprising:

a frame defining a front end and a rear end, and having an opening extending from said front end to said rear end;

a ledge formed in said opening adjacent said rear end;

a substratum adapted to be received in said opening;

a flange formed at one end of said substratum and adapted to abut said ledge;

a plurality of terminals embedded in and extending from said substratum; and a radiused lip formed at said rear end adjacent said ledge, whereby said substratum is retained by said radiused lip engaging said flange and holding said flange against said ledge.

2. The electrical receptacle of claim 1, further comprising:

a plurality of ledges formed in said opening adjacent said rear end;

a plurality of flanges formed at one end of said substratum and adapted to abut a ledge of said plurality of ledges; and a plurality of radiused lips formed at said rear end adjacent said plurality of ledges.

3. The electrical receptacle of claim 1, further comprising:

a second opening in said frame extending from said front end to said rear end;

a second ledge formed in said second opening adjacent said rear end;

a second substratum adapted to be received in said second opening;

a second flange formed at one end of said second substratum and adapted to abut said second ledge;

a plurality of second terminals embedded in and extending from said second substratum; and a second radiused lip formed at said rear end adjacent said ledge, whereby said second substratum is retained by said radiused lip engaging said second flange and holding said second flange against said second ledge.

4. The electrical receptacle of claim 3, further comprising:

a plurality of second ledges formed in said second opening adjacent said rear end;

a plurality of second flanges formed at one end of said second substratum and adapted to abut a ledge of said plurality of second ledges; and a plurality of second radiused lips formed at said rear end adjacent said plurality of second ledges.

5. The electrical receptacle of claim 4, wherein said second radiused lips are disposed opposite to said radiused lips to form opposing pairs of radiused lips, and said flanges are disposed opposite to said second flanges to form opposing pairs of flanges.

6. The electrical receptacle of claim 1, wherein said frame is made of metal and said radiused lips are formed by a casting peen.

7. An electrical receptacle comprising:

a frame defining an upper end and a lower end;

first and second terminal carrying wafers;

said frame having two parallel spaced apart channels extending through said frame from said upper end to said lower end, each said channel having a first width, and a retention portion at both longitudinal ends thereof and midway between both longitudinal ends, each said retention portion disposed axially above said first width and having a second width greater than said first width thereby defining a shelf therebetween, and a radiused protrusion extending into said second width;

said first and second wafers respectively disposed in said channels, each said wafer having a longitudinal leg with a first and second end and sized to extend into said first width of said respective first and second channels, each said leg having a plurality of terminals and a first, second, and third transverse tab each respectively disposed at said first and second ends and at said midway of said channels, said first, second, and third transverse tabs adapted to abut said respective shelves when said wafer is inserted into said receptacle and to be releasably retained by said respective radiused protrusions.

8. The electrical receptacle of claim 7, wherein each said midway retention portion includes a fourth radiused protrusion extending into said second width, and each said leg includes a fourth transverse tab.

9. The electrical receptacle of claim 7, wherein said frame is formed of metal and said radiused protrusions are formed by casting a peen on said lower end.

10. An electrical receptacle comprising:

a) a metal frame defining a front end and a rear end, said frame having first and second parallel spaced longitudinal grooves each having a predetermined width and extending from said front end to said rear end, each of said grooves defining a first end, a second end, and an intermediate portion, and having a first retention segment disposed at said first end having a width greater than said predetermined width and defining a first ledge therebetween, said first retention segment including a first protuberant, a second retention segment disposed at said second end and having a width greater than said predetermined width and defining a second ledge therebetween, said second retention segment including a second protuberant, and a third retention segment disposed at said intermediate portion and having a width greater than said predetermined width and a length longer than said first or second retention segment and defining a third ledge therebetween, said third retention segment including a third and fourth protuberant; and b) a first and second plastic wafer each having a plurality of terminals embedded therein and sized to be received within said predetermined width of respective said first and second grooves, each said wafer defining a first end, a second end, and an intermediate portion correlating in position to said first end, said second end and said intermediate portion of said frame when said wafer is inserted into said groove, each said first end having a first transverse projection, each said second end having a second transverse portion, and each said intermediate portion having a third and fourth transverse portion, each said transverse portion adapted to abut the respective first, second, and third ledge when said wafer is inserted into said groove and said first, second, third, and fourth protuberants releasably retaining said wafers from egress therefrom.

11. The electrical receptacle of claim 10, further comprising:

a first and second end cap, said first end cap disposed on a first wall formed integral with said frame adjacent said first channel and adapted to receive ends of said plurality of terminals of said first wafer, said second end cap disposed on a second wall formed integral with said frame adjacent said second channel and adapted to receive ends of said plurality of terminals of said second wafer.

* * * * *